United States Patent [19]
Carone
[11] 4,354,322
[45] Oct. 19, 1982

[54] HAND GUN WITH IMPROVED BARREL MOUNTING PIN

[76] Inventor: Robert A. Carone, R.D. No. 1, Dansville, N.Y. 14437

[21] Appl. No.: 187,504

[22] Filed: Sep. 15, 1980

[51] Int. Cl.³ ..... F41C 23/00; E16B 13/06

[52] U.S. Cl. ..... 42/75 D; 42/40; 411/24; 411/77; 411/61

[58] Field of Search ..... 42/75 D, 75 B, 40; 411/24, 75, 77, 57, 60, 61

[56] References Cited

U.S. PATENT DOCUMENTS

| | | | |
|---|---|---|---|
| 226,893 | 4/1880 | Van Gieson | 42/40 |
| 241,466 | 5/1881 | Wilson | 42/40 |
| 323,022 | 7/1885 | Boone | 411/24 X |
| 822,668 | 6/1906 | Jäger | 42/40 |
| 914,103 | 3/1909 | Berry | 411/24 |
| 945,403 | 1/1910 | Mohun | 411/24 |
| 2,832,167 | 4/1958 | Fox | 42/75 D |
| 2,872,227 | 2/1959 | Wachs | 411/24 X |
| 3,009,747 | 11/1961 | Pitzer | 411/24 X |
| 3,432,214 | 3/1969 | Cashman et al. | 411/24 X |
| 4,078,471 | 3/1978 | Archibald et al. | 411/24 X |

FOREIGN PATENT DOCUMENTS

| | | | |
|---|---|---|---|
| 60919 | 5/1943 | Denmark | 411/24 |
| 739338 | 9/1943 | Fed. Rep. of Germany | 411/24 |
| 1313501 | 2/1962 | France | 42/40 |
| 260608 | 3/1949 | Switzerland | 42/75 D |

*Primary Examiner*—David H. Brown
*Attorney, Agent, or Firm*—Shlesinger, Fitzsimmons & Shlesinger

[57] ABSTRACT

The frame of a hand pistol has in its forward end a pair of spaced furcations between which the lug on a removable gun barrel is pivotally mounted by means of an adjustable mounting pin, which permits the barrel to be pivoted between an open or loading position, and a closed or firing position. The adjustable pin comprises an Allen-head screw having a cylindrical head positioned snugly in a circular bore formed in one furcation, and a reduced-diameter, externally-threaded shank, which extends coaxially through a bore in the barrel lug, and which is threaded into an annular nut that is positioned snugly in a registering bore in the other furcation. One or more radially expansible sleeves surround the reduced-diameter shank of the screw of the bore of the barrel lug, and are designed so that when the nut is threaded toward the head of the screw, the sleeve or sleeves expand slightly radially, if necessary, to take up any undesirable slack which might otherwise exist as between the frame and the removable barrel, thus increasing the accuracy of the gun and minimizing its head spacing. Either a single sleeve having therein one or more longitudinally extending slots can be used; or a series of sleeves, the confronting ends of which have sliding engagement along a plane inclined to the axis of the screw, can be employed.

10 Claims, 5 Drawing Figures

HAND GUN WITH IMPROVED BARREL MOUNTING PIN

This invention relates to hand guns, and more particularly to hand guns of the type having replaceable barrels, which are releasably attached by removable mounting pins to the gun frames. Even more particularly, this invention relates to an improved mounting pin for accurately securing barrels of the type described to their associated gun frames.

Competitive target shooting with hand guns requires the use of an extremely accurate firearm. One such event which has become extremely popular in recent years involves the use of metallic targets that are designed to be struck and knocked over by bullets fired from hand guns. Typically, several series of such targets are employed, starting with a series of relatively small targets placed at close range, and progressing to a series of extremely heavy targets at long range. Although a competitor must use the same gun throughout a given match, different guns may be used for different matches. As a consequence, guns having replaceable barrels have become popular because they give a competitor the option to choose any one of a number of different barrels for a given match.

For example, Thomson: Center Arms of Rochester, New Hampshire manufactures a hunting and/or target practice hand gun the frame of which is designed to accommodate any one of a plurality of differently sized gun barrels, so that the same gun can be used to fire multicaliber bullets. A gun of this type therefore, is particularly suited for use in competition involving the above-noted metallic target meets, because a new or different barrel can be readily substituted each time a different caliber is desired for use in any particular match.

One of the major difficulties heretofore encountered in connection with hand guns of the type described is that the accuracy of the gun tends to vary rather considerably from barrel to barrel. In the case of one such prior gun, for example, each replaceable barrel has a lug projecting from its underside adjacent its breech section; and this lug is pivotally connected by a cylindrical mounting pin between the legs of a furcation which is formed on a forward end of the associated gun frame. When thus attached to the gun frame, the barrel is pivotal into and out of a locked position in which its bore registers properly with the firing pin which reciprocates in the frame forwardly of the hammer. With this type of mounting it has been discovered that the accuracy of the gun is changed each time the gun barrel is changed or replaced.

Not only is the accuracy of the above-noted gun inconsistent, but also its head spacing (the space between the rear end of the barrel and the confronting surface on the gun frame) tends to vary considerably from barrel to barrel. Ideally this head space is held to a minimum to prevent any undesirable expansion of the brass casing of a bullet or shell during the firing of a gun. Since most competitors reload and use such shell casings over and over again, it is desirable to minimize any such expansion of the shell casings, because this in turn reduces the need for working the brass casings when they are resized during the reloading process, and consequently prolongs the useful life of a casing. Moreover, with minimum head space the likelihood of any undesirable separation or splitting of a shell casing is minimized.

Accordingly, it is an object of this invention to provide improved means of releasably mounting replaceable gun barrels on the frames of hand guns of the type described, thereby to improve the reliability of the guns by eliminating variations in their accuracy from barrel to barrel.

Another object of this invention is to provide for hand guns of the type described improved barrel mounting means which minimizes the existence of undesirable head spacing in the guns.

A more specific object of this invention is to provide an improved, adjustable mounting pin for pivotably attaching replaceable gun barrels to the frames of hand guns of the type described.

Still another object of this invention is to provide an improved mounting pin of the type described which can be adjusted accurately and securely to mount each of a plurality of different gun barrels on the same frame of a hand gun so as to increase the accuracy of the gun, and to reduce the head space thereof, as compared to prior such guns.

Other objects of the invention will be apparent hereinafter from the specification and from the recital of the appended claims, particularly when read in conjunction with the accompanying drawings.

Figure 1:
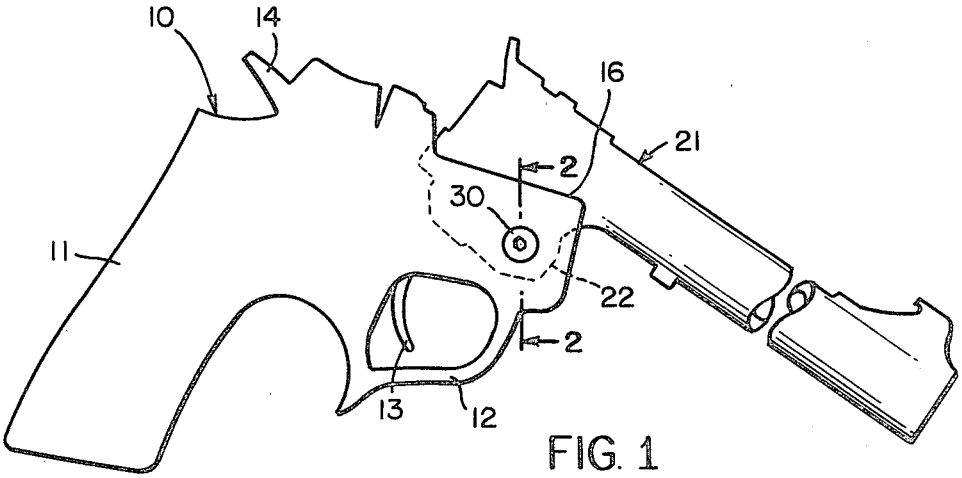
FIG. 1 is a diagramatic side elevational view of a hand gun incorporating an improved gun barrel mounting pin of a type made according to one embodiment of this invention, the gun being shown with its front stock removed and with its barrel disposed in its open or loading position.
Figure 2:
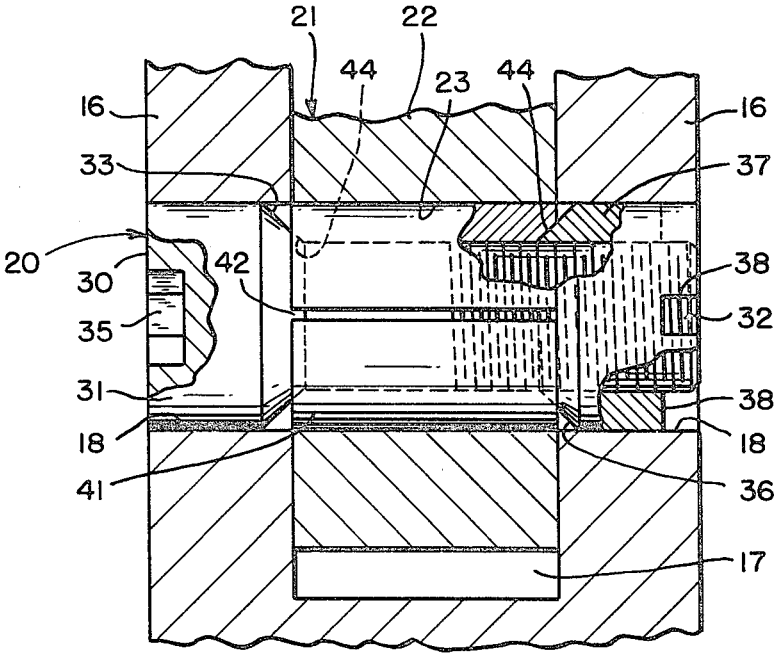
FIG. 2 is an enlarged, fragmentary sectional view taken generally along the line 2—2 in FIG. 1 looking in the direction of the arrows, and with portions of this novel barrel mounting pin being shown in full.

Referring now to the drawings by numerals of reference, and first to FIGS. 1 and 2, 10 denotes generally the frame of a pistol frequently employed in metallic target competitions of the type noted above. The frame 10 has the usual hand grip section 11, a trigger guard 12 for the trigger 13, and a pivotal hammer 14, the operation of which forms no part of this invention. On its forward end frame 10 has two, spaced, parallel, upstanding legs or furcations 16, (FIG. 2) which form in the frame forwardly in the hammer 14 an elongate slot or groove 17 (FIG. 2) for a purpose noted hereinafter. The two furcations 16 have therein a pair of registering, circular openings 18, which are equal in diameter, and which open on opposite sides, respectively, of the slot 17.

Releasably attached adjacent its rear end to the forward end of the gun frame 10 by a novel mounting pin 20 is a conventional gun barrel 21. Barrel 21 is one of several different types of barrels which are adapted to be attached releasably to frame 10 by means of an integral lug 22, which projects from the underside of each such barrel adjacent its rear or left end as shown in FIG. 1. Each such lug 22 has a pair of spaced parallel sidewalls which are separated a distance approximately equal to the space between the frame legs 16, so that each lug 22 will fit snugly and movably between the legs 16 as noted hereinafter. Moreover, each such lug 22 has therethrough a circular bore 23 (FIG. 2) the axis which extends right angles to, and transversely between, the opposed side walls of the lug so as to be registerable coaxially with the openings 18 in the frame legs 16, as shown in FIG. 2. Also as will be apparent from FIG. 2, the diameters of the registering openings 18 and 23 are substantially equal.

Heretofore it was customary to secure the lug 22 of a barrel 21 between the frame legs 16 by means of a solid, cylindrical mounting pin (not illustrated), which was removably inserted into and which extended snugly through, the registering bores 18 and 23. When mounted in this manner the associated gun barrel 21 was then pivotal from its open position (FIG. 1) to a closed position (not illustrated) in which its rear end was latched by known means in a firing position with the rear end of its bore disposed in registery with the firing pin of the gun. The gun could then be cocked and fired, after which the barrel latching means was released manually in a known manner, so as to enable pivotal movement of the barrel 21 back to its open position. Because of the variations in the sizes and positions of the bores 23 in the mounting lugs 22 on different barrels 21, prior or conventional mounting pins have resulted in the above-noted unsatisfactory accuracy from barrel to barrel, and the inconsistent head spacing.

Referring now to FIG. 2, the improved mounting pin 20 which obviates the above-noted disadvantages of conventional mounting pins, comprises a flat, Allen-head cap screw 30 having a cylindrical head 31, an integral, reduced-diameter, externally-threaded shank 32, and a truncated-conical shoulder section 33 formed at the juncture of its head and shank sections. The screw 30 has an overall length approximately equal to the distance between the outside surfaces of the frame legs 16, and has plane, transverse end surfaces which, in use, are disposed approximately coplanar with the outer surfaces of the frame legs 16 so as not to interfere with the removable front stock (not illustrated) of the gun. Head 31 of the screw, which has in its outer end the usual recess 35 for accommodating the end of an Allen wrench, fits snugly and slidably in an opening 18 in one of the frame legs 16.

Adjustably threaded onto the shank 32 of the screw 30 in the bore 18 of the other frame leg 16 is an annular nut 37, the outside diameter which also is approximately equal to the diameter of the bore 18 in which it is positioned. The nut 37 has formed on its inner end a beveled surface 36 which is similar to, but inclined oppositely to, the truncated-conical shoulder 33 on screw 30. The nut 37 has a castellated outer end containing four, equiangularly spaced notches 38 (only three of which are shown in FIG. 2) for accommodating the forked head of a conventional tool, which can be employed to hold the nut 37 against rotation during its adjustment of screw 30 as noted hereinafter.

Mounted in the bore 23 of the barrel lug 22, and surrounding the part of the screw shank 32 that extends between the frame legs 16, is a split sleeve or ring 41, which is made from a piece of hardened, precision machined steel, or the like. Ring 41 has in its annular wall a longitudinally extending slot 42, which extends continuously between opposite ends of the ring to enable radial expansion thereof. Also, opposite ends of the ring 41 are countersunk or otherwise machined to form on opposite ends of its bore wall beveled or truncated-conical surfaces 44, which are engagable, respectively, with the inclined shoulder 33 on the screw 30, and with the tapered surface 36 formed on the inner end of nut 37. Also as shown more clearly in FIG. 2, the overall length of the ring 41 is such that it can be positioned entirely within the bore 23 of the barrel lug 22, and therefore does not project axially into either bore 18 in the frame legs 16.

In order to remove barrel 12, it is first pivoted to its open position, (FIG. 1), and the nut 37 is then backed off or adjusted toward the right on the screw shank 32 in order to release any axial pressure which may be exerted against opposite ends of ring 41 by screw head 31 and nut 37. This enables the ring 41 to contract radially until its outer diameter is, in practice, approximately equal to the diameter of the bore 23 in the barrel lug. 22. At this time the pin 20 can then be readily removed from the bores 18 and 23 merely by tapping one end or the other of the pin. After it has been removed, and assuming that it is desirable to replace the existing gun barrel, a second gun barrel having a lug 22 is mounted on the frame 10 so that the bore 23 in its lug 22 registers approximately with the openings 18 in the frame furcations 16. The pin 20 is then reinserted into the registering bores 18 and 23 until it assumes approximately the position as shown in FIG. 2, wherein opposite ends of the pin register approximately with the outer surfaces of the frame legs 16. At this time the pin 20 can be adjusted by rotating screw 30 relative to nut 37 (or vice versa) to cause the split ring 41 to expand slightly in a radial direction in order to take up any undesirable play that might exist in the bore 23 of the new barrel lug. This adjustment causes the nut 37 to be drawn, by way of example, axially toward the left on the screw shank 32 as shown in FIG. 2, thereby causing the inclined surfaces 33 and 36 on the screw 30 and nut 37, respectively, to exert equal and opposite forces against opposite ends of the split ring 41. The split ring therefore tends to expand radially, as permitted by the slot 42 in the ring, thereby increasing the diameter of the ring until its outer peripheral surface snugly engages against the bore wall 23 of the barrel lug 22.

This expansion of ring 41 does not interfere in any way with the ability of the barrel 21 to be pivoted between its open and closed positions. This type of adjustment, however, does have the beneficial effect of taking up any undesirable slack which might otherwise occur in the mounting as between a frame 10 and a new gun barrel 21. Likewise this adjustment tends to reduce the amount of head space in the gun thereby not only increasing its accuracy, as noted above, but also prolonging the life of shell casings that are employed in the gun.

In the example illustrated the tapered, mating surfaces 33, 36, and 44 on the screw 30, the nut 37 and the split ring 41, respectively, are formed at an acute angle to the axis of the pin 20, and by way of example, at an angle of approximately 30° or 45°. Obviously, however, the degree of inclination of these contacting surfaces can be varied slightly without departing from this invention.

Figure 3:
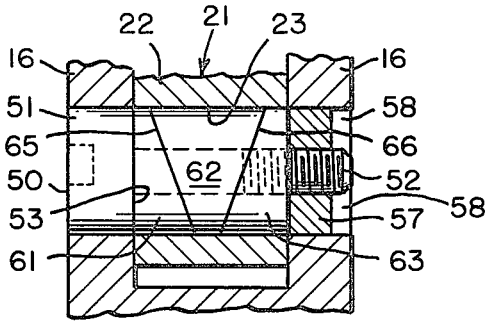
FIG. 3 is a fragmentary sectional view generally similar to FIG. 2, but illustrating a modified form of this barrel mounting pin.

Referring now to the modified pin shown in FIG. 3, wherein like numerals are employed denote elements similar to those employed in the first embodiment, 50 denotes a flat, Allen-head type of screw having a cylindrical head 51, and a reduced-diameter, externally threaded shank section 52. In this embodiment the juncture between the head and shank sections of the screw is defined by a plane, transverse surface 53, which lies in a plane that extends at right angles to the axis of the screw. Also unlike the first embodiment, the castellated nut 57 in this embodiment has four, tool-accommodating notches 58 in its outer end, but has a plane, transverse inner end or surface 56, which extends parallel to the plane surface 53 on the head 51 of the screw. As shown more clearly in FIG. 3, these plane surfaces 53 and 56 are disposed to be in approximately coplanar registry with the inside surfaces of the frame legs 16, when the barrel 21 is mounted as shown in FIG. 3.

In this second embodiment three, separate ring members 61, 62 and 63 are mounted in the bore 23 of the barrel lug 22 to surround the portion of the screw shank 52 which extends between the frame legs 16. Each ring 61, 62 and 63 extends without interruption around a portion of the screw shank 52; and the outer ends of the two outer rings 61 and 63 have formed thereon plane surfaces which are disposed to have coplanar registery with the plane surfaces 53 and 56 on the screw head 51 and the nut 57, respectively. However, opposite ends of the inner ring 62, and the confronting, inner ends of the outer rings 61 and 63, are plane surfaces which are inclined at an angle, for example approximately 60°, to the axis to the screw shank 52. As a consequence, the confronting ends of the rings 61 and 62 lie in a plane 65 (FIG. 3) inclined in one direction to the axis of the pin 50, while the confronting, coplanar surfaces of the rings 62 and 63 engage each other along a plane 66 (FIG. 3), which is inclined in the opposite direction relative to plane 65.

As the result of the construction illustrated in FIG. 3, when the nut 57 is rotated to cause its advance toward the head on the screw 50, the axial pressure exerted on the outer ends of the rings 61 and 63 cause the confronting surfaces on the three rings to slide slightly relatively to one another, and in turn cause ring 62, for example, to be shifted slightly radially outwardly from the axis of the shank 52 relative to the rings 61 and 63. It has been found that this construction also results in more uniform accuracy and smaller head clearance in guns of the type described.

Figure 4:
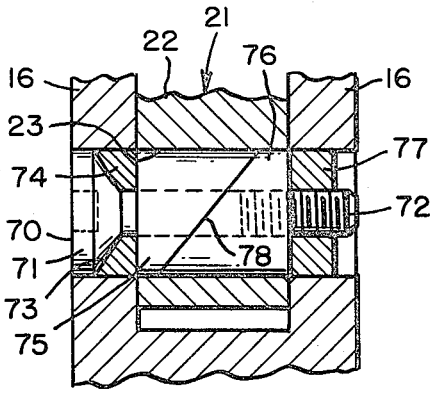
FIG. 4 is a fragmentary sectional view also similar to FIG. 2, but illustrating still a further modification of this mounting pin.

In the embodiment shown in FIG. 4, 70 denotes an Allen-head screw having a modified head section 71, and a reduced-diameter, externally-threaded shank section 72. In this embodiment the inner end of head 71 has formed thereon a truncated-conical surface 73, which seats against a correspondingly inclined surface formed on one end of an annular washer 74, which surrounds the screw 70 at the juncture of its head 71 and shank 72.

In this embodiment (FIG. 4), two annular members 75 and 76 surround the screw shank 72 between the legs 16 of the frame, and are held thereon by a nut 77 similar to the nut 57 shown in FIG. 3. The outer ends, respectively, of members 75 and 76 lie in transverse planes which nearly are coplanar with the inner surfaces of the frame legs 16. The inner ends of the annular members 75 and 76, however, comprise plane, inclined surfaces which engage each other so at 78 along a transverse plane which is inclined at approximately 45° to the axis of the shank 72. As a consequence, when the nut 77 in this embodiment is tightened, the axial pressure placed against the outer ends of members 75 and 76 cause them to shift slightly radially in opposite directions relative to each other along the juncture 78, thereby taking up any slack which might otherwise exist as between the associated barrel 21 and frame 10.

Figure 5:
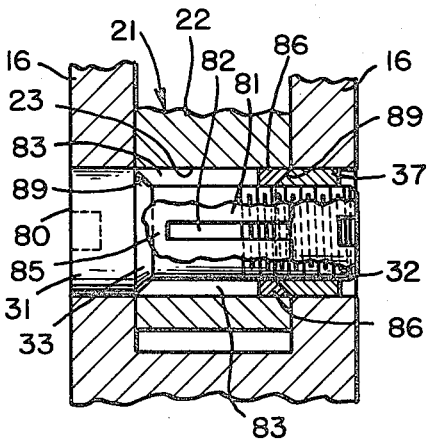
FIG. 5 is a fragmentary sectional view similar to FIG. 2, but illustrating still a third modification of this barrel mounting pin.

The embodiment shown in FIG. 5 illustrates a modified pin in which the Allen-head screw 80 and the associated nut 37 are identical to those employed in the first embodiment. The screw, therefore, has a cylindrical head 31 and a threaded shank 32 connected by a truncated-conical shoulder section 33. In this embodiment, the screw shank between frame legs 16 is surrounded by a modified ring or member 81 having in diametrally opposite sides thereof a first pair of registering, longitudinally extending slots 82 (only one of which is shown in FIG. 5), which extend part way in from the right end of ring 81, and a second pair of registering, longitudinally extending slots 83, which are positioned at 90° intervals from the slots 82, and which extend part way in from the left end of member 81. Slots 82 therefore form on the left end of ring 81 two, diametrally opposed portions 85, which support substantially the upper half of member 81 in cantilever fashion from the lower half thereof, while the other two slots 83 leave portions 86 at diametrally opposite sides of member 81 adjacent the right end thereof, for supporting two other opposed sections of the member 81 in cantilever fashion about the respective portions 86 of the member.

Also as shown in FIG. 5 opposite ends of the bore in member 81 have formed thereon beveled surfaces 89 which are engagable by the complimentarily inclined surfaces on the inner end of the screw head 31 the nut 37, respectively. It will be apparent, therefore, that as the nut 37 is threaded onto the shank section 32 of this screw, the inclined surfaces on the inner ends of the head 31 and the nut 37 will cause portions of the ring member 81 to be expanded radially, and snugly into engagement with the bore 23 on the barrel lug 22. As in the case of the preceeding embodiments, the adjustable pin 80 thus permits the take-up of any undesirable slack which might otherwise exist between the barrel 21 and the frame to which it is attached.

From the foregoing, it will be apparent that this invention provides a relatively simple and inexpensive means for dramatically increasing the accuracy of hand guns of the type described. Moreover, by proper adjustment of the novel mounting pins disclosed herein it is possible also to minimize the amount of head clearance in each such gun, thereby to prolong the life of the associated cartridges or gun shells that are used.

Still another advantage of this type of mounting pin is that it can be readily adjusted and/or removed through the use of simple hand tools, such as for example, an Allen wrench, and a conventional tool of the type which is employed for operating castellated nuts. Of course, while in the illustrated embodiments the use of an Allen-head screws and castellated nuts has been suggested, it will be apparent to one skilled in the art that modifications of such screws and nuts can be employed without departing from this invention. Moreover, while only certain embodiments of the invention have been illustrated and described in detail herein, it will be apparent that this application is intended to cover any such further modifications thereof that may fall in the scope of one skilled in the art or the appended claims.

I claim:

1. In a hand pistol having a frame, a removable gun barrel, and a lug projecting from the underside of said barrel into a space between two furcations formed on the forward end of said frame, improved means for pivotally connecting said lug to said furcations to allow pivotal movement of said barrel on said frame between loading and firing positions, respectively, comprising a screw having a cylindrical head removably positioned coaxially in a circular bore in one of said furcations and having an integral, reduced-diameter, externally-threaded shank projecting coaxially through a registering bore in said lug and coaxially into a circular bore formed in the other of said furcations, an annular, internally-threaded nut adjustably threaded onto said shank of said screw and disposed coaxially and removably in said bore in said other furcation, and radially expansible means removably mounted in said bore in said lug, and surrounding said shank between said nut and the cylindrical screw head to be compressed therebetween when said nut is threaded onto said shank toward said screw head, said radially expansible means having thereon at least two bearing surfaces which are inclined to the axis of said screw shank, and each of which is slidable at least in part in a direction radially of said axis relative to a complimentarily-shaped bearing surface with which it is engaged, when compressed between said nut and said screw head.

2. A hand pistol as defined in claim 1, wherein the overall length of said screw is approximately equal to the combined thicknesses of said lug and said two furcations.

3. A hand gun as defined in claim 1, wherein said radially expansible means has an overall length approximately equal to the thickness of said lug, whereby said means may be positioned completely within the bore in said lug.

4. A hand gun, as defined in claim 1, wherein said means comprises a sleeve surrounding said shank, and said two bearing surfaces comprise countersunk, truncated-conical surfaces formed in opposite ends of the bore in said sleeve coaxially thereof, said two bearing surfaces on said sleeve are engaged by two similarly shaped, truncated-conical surfaces formed on the confronting ends of said screw head and said nut, respectively, and said sleeve has therein at least one longitudinally extending slot which permits radial expansion of said sleeve when said nut is advanced toward said screw head.

5. A hand gun as defined in claim 4, wherein a single slot is formed in said sleeve and extends without interruption from one end thereof to the other.

6. A hand gun as defined in claim 4, wherein said sleeve has therein a first plurality of angularly spaced, axially extending slots which extend from one end of the sleeve part way only toward the opposite end thereof, and a second plurality of spaced, axially extending slots angularly offset from said first plurality, and extending from said opposite end of said sleeve part way only toward said one end thereof.

7. A hand gun as defined in claim 1, wherein said radially expansible means comprises at least two sleeves surrounding said shank between said two furcations, said two bearing surfaces comprise a pair of plane surfaces formed on the confronting ends, respectively, of said two sleeves, and said plane surfaces have coplanar, sliding engagement along a plane inclined to the axis of said shank, whereby upon advance of said nut toward said screw head, said sleeves are subjected to axial compression, thereby urging one of said inclined bearing surfaces to slide relative to the other.

8. A hand gun as defined in claim 7, wherein said sleeves are engaged between a pair of confronting, transverse surfaces formed on the inner ends of said screw head and said nut, respectively, and said pair of transverse surfaces lie in a pair of spaced, parallel planes extending at right angles to the axis of said screw shank.

9. A hand gun as defined in claim 7, wherein there are three sleeves surrounding said shank between said furcations, one of said sleeves is positioned between the other two sleeves, and opposite ends of said one sleeve have thereon plane surfaces, which have coplanar engagement with complimentary plane surfaces formed on the confronting ends of the other two sleeves, and which surfaces lie in a pair of spaced planes inclined to the axis of said screw shank.

10. A hand gun as defined in claim 9, wherein said pair of planes are inclined in different directions relative to said axis.

* * * * *